United States Patent [19]

Tetenborg et al.

[11] Patent Number: 4,913,765

[45] Date of Patent: Apr. 3, 1990

[54] APPARATUS FOR MAKING BAGS OR SACKS FROM A PREFERABLY GUSSETED CONTINUOUS TUBULAR FILM OF THERMOPLASTIC PLASTIC

[75] Inventors: Konrad Tetenborg; Helmut Hüwelmann, both of Lengerich i.W., Fed. Rep. of Germany

[73] Assignee: Windmöller & Höscher, Lengerich, Fed. Rep. of Germany

[21] Appl. No.: 190,442

[22] Filed: May 5, 1988

[30] Foreign Application Priority Data

May 11, 1987 [DE] Fed. Rep. of Germany ... 371568503

[51] Int. Cl.[4] ..... B65B 43/30

[52] U.S. Cl. ..... 156/498; 53/253; 156/515; 156/538

[58] Field of Search ..... 53/562, 567, 570, 249, 53/250, 253; 156/538, 251, 515, 498

[56] References Cited

U.S. PATENT DOCUMENTS 3,607,574 9/1971 Satake ..... 156/515
3,948,019 4/1976 Doring et al. ..... 53/253 X
4,108,300 8/1978 Hayase ..... 53/570 X
4,353,198 10/1982 Koppe ..... 53/570
4,534,158 8/1985 McClosky ..... 53/570 X
4,975,888 8/1976 Jones ..... 53/570 X

*Primary Examiner*—David Simmons
*Attorney, Agent, or Firm*—Fleit, Jacobson, Cohn, Price, Holman & Stern

[57] ABSTRACT

An apparatus is disclosed for making bags or sacks from a continuous tubular film of thermoplastic material. The continuous tubular film is moved intermittently in a downward direction to a welding device, a cutter below the welding device, and a turret-like rotary conveyor below the cutter. A bag length is received by grippers on the rotary conveyor before it is welded and cut. When thus received the bag length is welded and cut, and the conveyor indexed by one step to present succeeding grippers to the tube. The tube is then advanced another bag length so that the succeeding bag is received in the succeeding pair of grippers. The process is repeated with succeeding bags. The bags on the conveyor are successively delivered to a transfer station where the grippers are opened to release the bags.

12 Claims, 5 Drawing Sheets

APPARATUS FOR MAKING BAGS OR SACKS FROM A PREFERABLY GUSSETED CONTINUOUS TUBULAR FILM OF THERMOPLASTIC PLASTIC

BACKGROUND OF THE INVENTION

This invention relates to an apparatus for making bags or sacks from a preferably gusseted continuous tubular film of thermoplastic material. The apparatus is of a type which comprises guide rollers and pinch rollers by which the leading end of a freely vertically depending continuous tubular film is adapted to be advanced in steps each corresponding to the length of one bag or sack to a position between welding jaws of a welding device, which are adapted to perform opening and closing movements in a horizontal plane to form successive weld seams in the film. The apparatus, also has a transverse cutter, which is disposed below the welding jaws, and pairs of grippers, which are disposed below the cutter. The grippers are provided on a conveyor by which the bags or sacks which have been successively severed from the film are adapted to be moved through a cooling section for cooling the bottom weld seam of each bag or sack to a transfer apparatus for conveying the bags or sacks to a filling device.

When materials are to be filled into sacks by manufacturers and/or fillers, this is often performed by means of filling machines, which are preceded by a machine for making the sacks to be filled. In the latter machine a preferably gusseted continuous tubular film of thermoplastic plastics is intermittently withdrawn from a supply roll and sacks consisting of tubular film sections provided with bottom welds are severed from the continuous tubular film shortly before the sacks are filled. When the sacks have been filled, they are provided with a closing seam at their top end. To ensure an adequate cooling of the bottom seam weld which has been made shortly before the sacks are filled so that said seam will have an adequate strength before the sacks are filled, it is advisable to feed the sacks provided to the filling apparatus through a cooling section.

German Patent Specification 24 18 228 describes an apparatus of the kind described hereinbefore and in which the cooling section has two mutually opposed chain conveyors, which are synchronously driven and have endless chains which are trained each around two chain sprockets on vertical axes. The chains carry spaced apart grippers, which while moving along the confronting and coplanar inner courses of the chains grip mutually opposite edge portions of the bags which have been provided with bottom welds and convey the bags to a transfer apparatus for conveying the sacks to the filling device. The known apparatus is rather expensive because two revolving endless chains and means for driving them are required. Only the grippers moving along the two confronting inner courses of the chains are utilized to convey the sacks whereas the grippers have no conveying function as they move around the driving and reversing sprockets and along the outer chain courses.

British Patent Specification 919,392 discloses an apparatus which is used to make and fill sacks and comprises a turret that is rotated in angular steps. In this apparatus the bottom seam is welded after the continuous tubular film has been advanced to the extent of one sack length so that the time required for a step is determined by the time required for the welding operation and by the time which is required to advance the continuous tubular film to the extent of one sack length. Also, this apparatus cannot be adjusted in a simple manner to accommodate different sack sizes because the welding device for forming the bottom seam is spaced a constant distance below the grippers whereby the elevation of the welding jaws must be changed for a change of the length of the sack.

Moreover, one of the stations associated with the turret constitutes the filling station so that a sufficiently long time for cooling the bottom seam weld is not assured.

A similar turret-like apparatus for making and filling sacks or bag is known from German Patent Specification 26 08 456.

SUMMARY OF THE INVENTION

It is an object of the invention to provide an apparatus of the kind described and which comprises a conveyor that includes a cooling section and comprises grippers which during intermittent operation of the conveyor perform virtually no idle movements.

In accordance with the invention, the conveyor comprises a hub-like carrier, which is mounted for rotation about a vertical axis and has radial arms, with the grippers arranged in pairs at the free ends of said arms. As a result, the cooling section in accordance with the invention is virtually constituted by a cooling turret, by which the sacks, which have been provided with a bottom weld and severed from the continuous tubular film are conveyed from a welding or receiving station along a circular path to an apparatus for transferring the sacks to a filling device. If the apparatus in accordance with the invention comprises four radial arms, as is preferred, a welding device and a cutting device will be provided above the first station so that one step of each cycle of operations performed to make a sack comprises the movement of a sack, which has previously been provided with a bottom weld, into the opened first pair of grippers from above and an advance of that sack by the length of one sack. Thereafter, the sack is gripped and cut off. A succeeding bottom weld is then formed at the leading end of the continuous tubular film while the cooling turret is rotated through a further step of 90° and is held in the resulting position until another sack provided with a bottom seam has been fed to the next succeeding station. In a four-armed cooling turret, the operation is repeated until the first arm has been rotated through 270° in three steps. At that time the bottom weld has sufficiently cooled and the sack is then transferred to a transfer apparatus, which transfers the sack to a filling device. The time required for that transfer does not exceed the time which is required to make a sack and to move it into the grippers. It is apparent that the turret in accordance with the invention serves effectively to cool the bottom welds. Owing to the use of rotary turret, a sufficiently long cooling path can be accommodated within a small space.

The apparatus in accordance with the invention differs from the apparatus in accordance with British Patent Specification 919,392 in that a welding means is disposed above the grippers and the cutting device and is spaced a fixed distance therefrom so that the apparatus can simply be adjusted to a different sack size by the selection of the extent to which the continuous tubular film is advanced in each step.

The grippers of each pair of grippers for retaining a bag or sack are suitably spaced equal radial distances from the axis of rotation of the carrier. This design ensures that the bags or sacks will hang tangentially from the turret-like conveyor so that the apparatus may be small in diameter. The arms which carry the grippers suitably have the same angular spacing.

Each arm of the apparatus in accordance with the invention is preferably provided with two grippers, each of which constitutes one of a pair of grippers together with the adjacent gripper of an adjacent arm. With this arrangement it is not necessary to provide the arms at their free ends with brackets having a width which is substantially as large as the width of the sacks.

To constitute the grippers, the arms may be provided at their free ends with brackets, provided on their outside with backing jaws, which cooperate with movable clamping jaws, which are secured to levers pivoted to the brackets on vertical axes. The movable clamping jaws of each pair of grippers are suitably linked to each other by a link to perform opening and closing movements in synchronism.

Those pairs of grippers which are disposed in the welding or receiving station and in the transfer station at a given time are suitably adapted to be opened and closed by a common actuator. Said pairs of grippers desirably perform their opening and closing movements in synchronism because a sack can be delivered during the time in which the next successing pair of grippers in the direction of rotation take up the sack which has been made last.

In accordance with a preferred feature of the invention, the pairs of grippers which are disposed in the welding station and in the transfer station at a given time are juxtaposed, the levers carrying the movable clamping jaws are biased toward their opening position by springs and carry sliders or rollers, and a wedge-shaped spreader is adapted to be moved between said sliders or rollers and has side faces which constitute tracks or cams for cooperation with the sliders or rollers. Thus a common device for opening two pairs of grippers is provided, which device is fixed to the frame, and there is no need for providing a corotating device for effecting the gripper opening and closing movements.

The spreader is desirably mounted on a lever, which is pivotally movable by a fluid-operable piston-cylinder unit about an axis which is stationary with respect to the frame.

In accordance with a preferred feature of the invention, each lever is provided with a cam follower roller, which during outward pivotal movement the lever is adapted to enter a cam slot in a plate which is fixedly connected to the rotary carrier. As a result that plate constitutes a safety plate, which will prevent damage to the apparatus when the turret is inadvertently advanced through an additional angular step although tee spreader still extends between two sliders or rollers.

The hub-like carrier is suitably driven by means of a drive pulley and an endless belt trained around the drive pulley and around a driven pulley that is connected to a gear motor, which is disposed between the transfer station and the receiving station. Because no sack workpiece is conveyed by the grippers between the transfer station and the welding station, there can be no collision between such sack workpiece and the drive belt in that region.

In accordance with a further feature of the invention a rake is pivoted on a horizontal axis which is stationary with respect to the frame, that rake is disposed above the welding station and at least on the inside of the depending continuous tubular film which is being supplied, and said rake is adapted to be swung out during each advancing step so that that end of the continuous tubular film which is provided with the bottom seam is separated from the welding jaws and can be moved without an obstruction through the succeeding cutting and clamping means. The rake is suitably mounted in annular grooves, which are formed in a pinch roller, and is pivotally movable about the axis of rotation of said roller. The pivotal movement of the rake may be derived from the opening movement of a clamping jaw which is disposed above the welding device so that the turning drive is simplified in structure.

DETAILED DESCRIPTION OF PREFERRED EMBODIMENT

Figure 1:
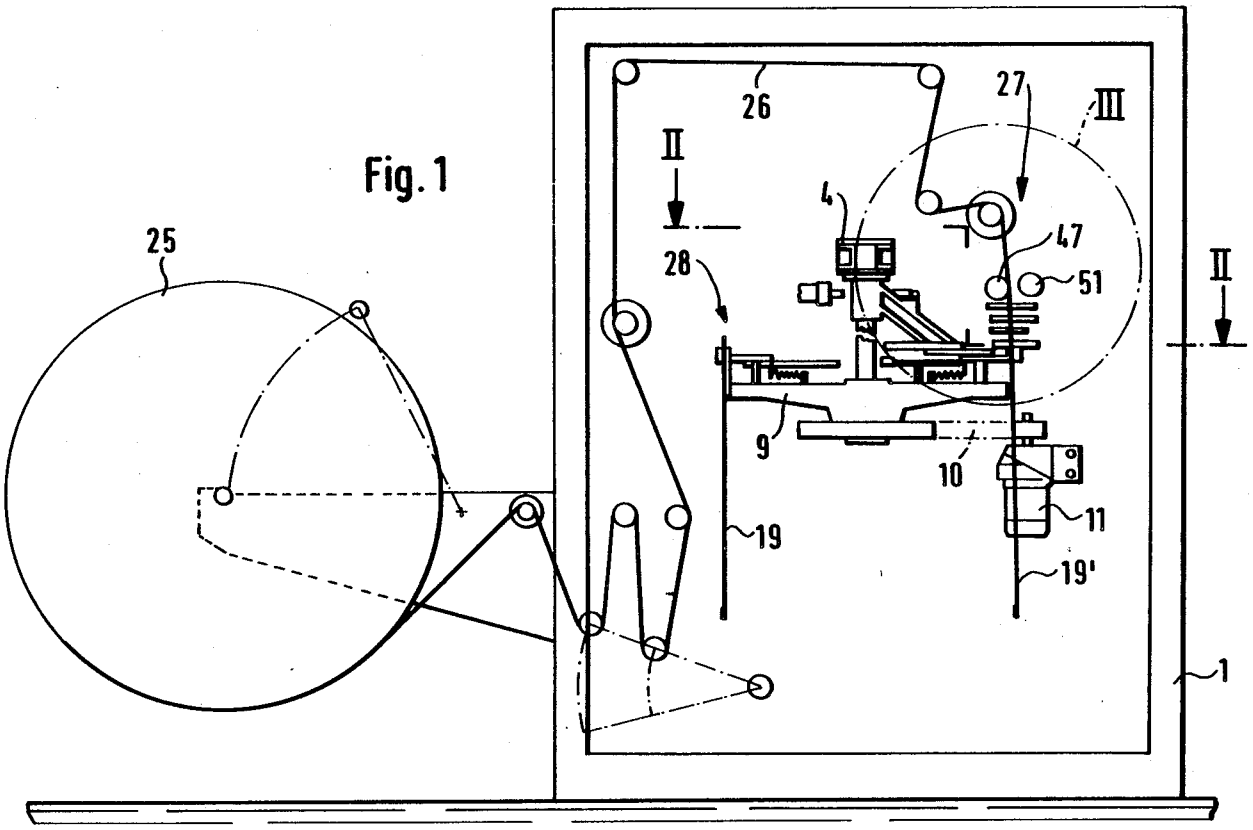
FIG. 1 is a diagrammatic side elevation showing an apparatus in accordance with the invention for making bags or sacks.

An illustrative embodiment of the invention will now be explained more in detail with reference to the drawing.

Figure 2:
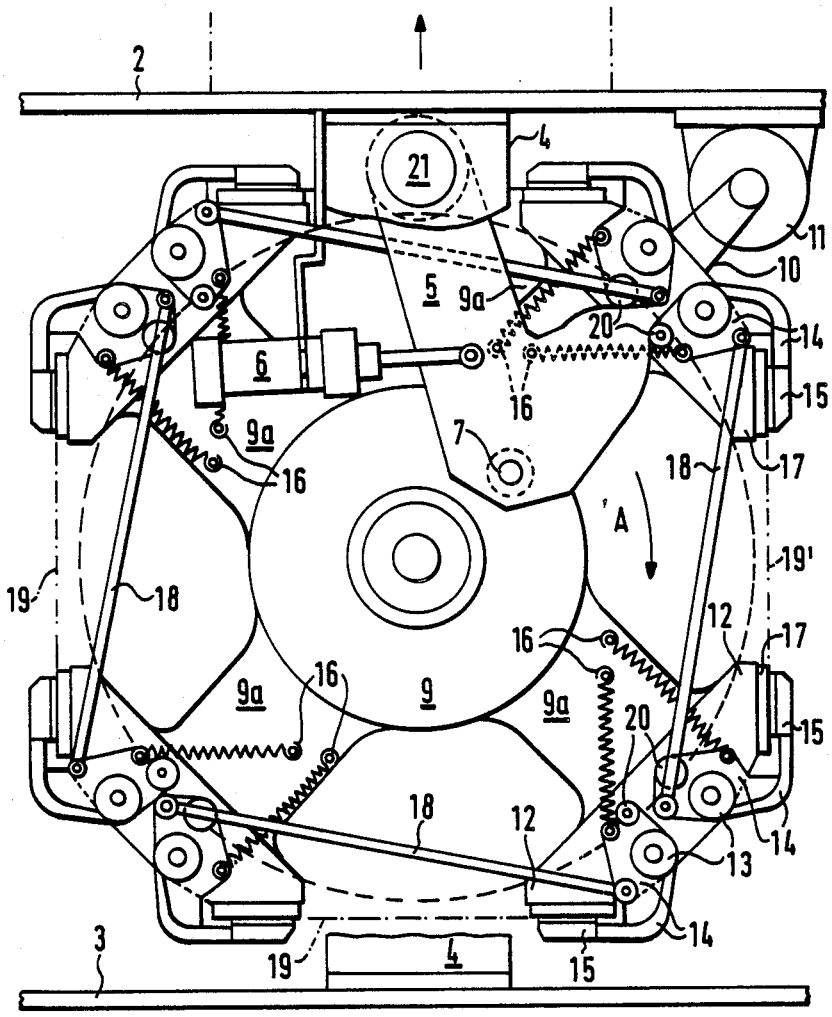
FIG. 2 is a sectional view taken on line II—II in FIG. 1.

A frame 1 comprises side walls 2 and 3, which are indicated in FIG. 2 and are interconnected by a cross-beam 4, which approximately at its center carries a depending fixed pivot 21. A pivoted arm 5 is pivoted on said pivot 21 close to the cross-beam 4 and is movable between two end positions by a fluid-operable piston-cylinder unit 6 having a cylinder which is fixed to the frame by a bracket (not shown).

Figure 5:
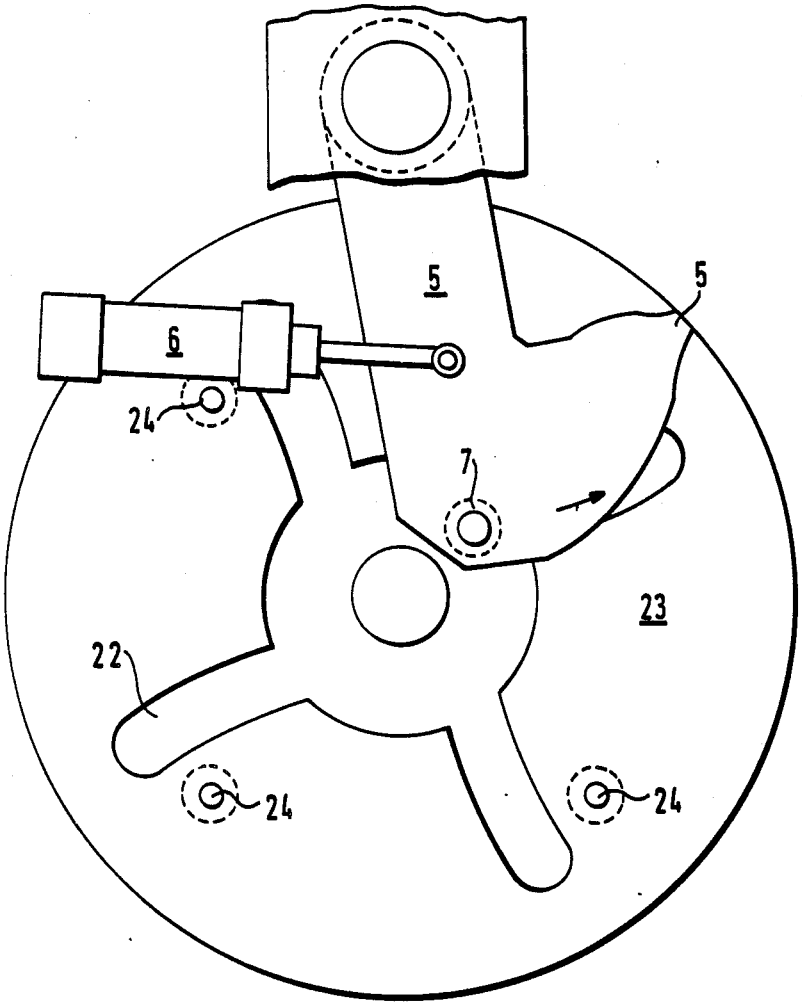
FIG. 5 is a top plan view showing a locking plate that is apparent from FIG. 4.

It is apparent from FIG. 5 that the pivoted arm 5 is constituted by a bell-crank lever, which at its free end comprises a camming portion 5'. Adjacent to its knee, the bell-crank lever is provided with a safety roller 7. The functions of said parts will be described more in detail hereinafter.

A vertical axle 8 is secured to the cross-beam 4 and below the pivoted arm 5 carries a four-armed spider 9, which is adapted to be rotated by a motor 11 and a cogged belt 10 in steps of 90°. The sense of rotation of the spider is indicated in FIG. 2 by an arrow A.

It is apparent from FIG. 2 that the rotary spider 9 comprises a hub-like carrier and four arms **9*a* which protrude from said hub-like carrier and carry brackets 12, each of which is provided with two upstanding pins 13. A lever 14 is pivoted on each pin 13 and at its free end constitutes a movable gripper jaw 15. Each of said gripper jaws 15 is biased by a spring 16 against an abutment surface or fixed gripper jaw 17, two of which are provided on each bracket 12. The two confronting levers 14 of two adjacent arms 9*a* are operatively connected by a link 18 so that the two associated grippers 15 open and close at the same time, e.g., to grip and retain a sack 19**.

The gripper jaws 15 are opened by the wedge- or wedge-shaped or curved cam faces of the camming portion 5' of the pivoted arm 5. As the pivoted arm 5 is pivotally moved by the extending piston rod of the fluid-operable piston-cylinder unit 6, the camming portion 5' forces apart pressure-applying rollers 20 which are mounted on the bracket 12 and connected to the levers 14. As a result, the grippers 15 are turned about the pivots 13 and are thus disengaged from the associated abutment surfaces 17. By means of the links 18 the grippers on adjacent brackets 12 are disengaged at the same time. In the position shown in FIG. 2, the gripper units 15 which are associated with the top and right-hand edges of the drawing will be disengaged by an actuation of the fluid-operable piston-cylinder unit 6. The right-hand pair of grippers are at the receiving station and the top pair of grippers are at the transfer station.

In order to ensure that an inadvertent starting of the motor 11 will not result in damage by the swung out camming portion 5', the safety roller 7 which is mounted adjacent to the bend of the pivoted arm 5 will enter a cam groove 22 formed in a locking plate 23 during a pivotal movement of the pivoted arm in a sense to open the grippers. As that locking plate 23 is fixed to the spider 9 by screws 24, the safety roller 7 mounted on the pivoted arm 5 will prevent a rotation of the spider 9 as long as the camming portion 5' is disposed between the rollers 20 of the bracket 12. When the camming portion is retracted from between the rollers 20, roller 7 enters a central opening in plate 23 allowing spider 9 to rotate.

Figure 3:
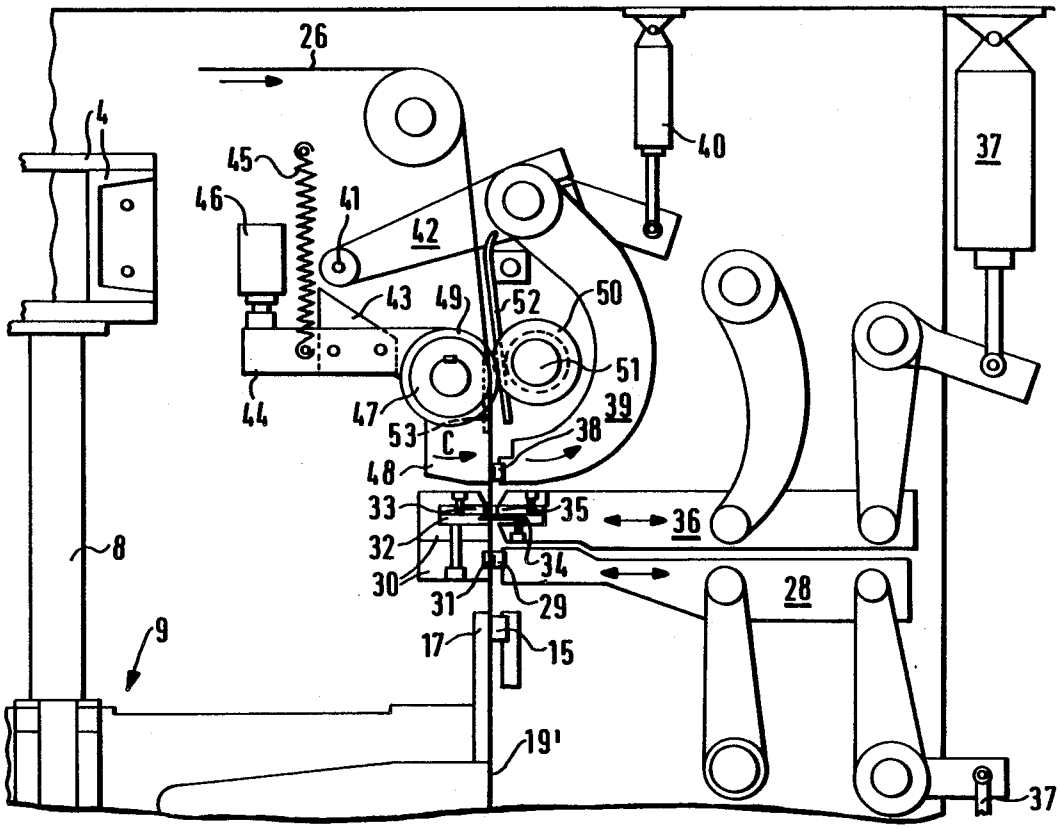
FIG. 3 is an enlarged view showing the detail that is surrounded by a dash-dot line in FIG. 1.
Figure 4:
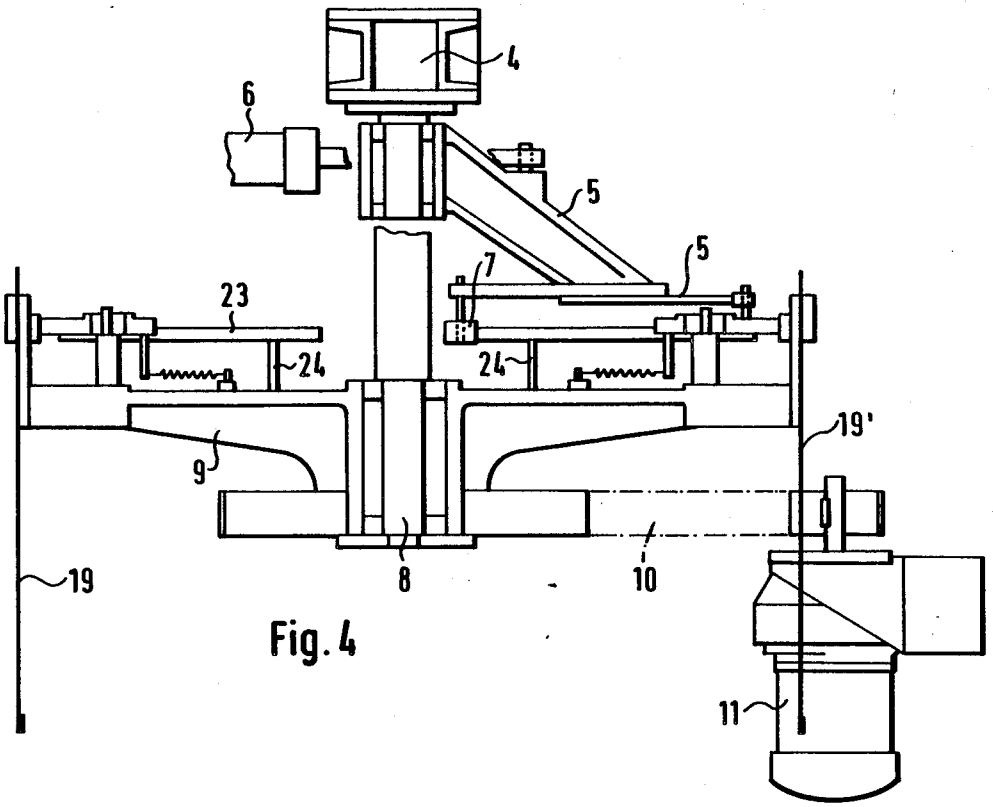
FIG. 4 is an enlarged view showing the intermediate portion of the apparatus of FIG. 1.

It is apparent from FIG. 1 that a continuous tubular film 26 withdrawn from a roll 25 enters a receiving station 27 from above. The receiving station 27 is fixedly connected to the frame 1 and is shown in more detail in FIG. 3, from which the central axle 8 of the cooling turret is apparent as well as a part of the rotary spider 9. A tubular film portion 19 which has been provided with a bottom seam is clamped by the grippers 15 and by the abutment surfaces 17 of the spider but is still connected to the continuous tubular film 26. Above the grippers 15 and the abutment surfaces 17, a link 28 is provided to which a parallel motion is imparted by cranks and which at that end that faces the continuous tubular film 26 carries a clamping bar 29, which cooperates with a backing bar 31 that is secured to a carrier 30, which is secured to the frame. In addition to the backing bar 31, the carrier 30 is provided with a knife-receiving groove 32 and a welding jaw 33. To sever the sack 19 from the continuous tubular film 26, a knife 34 is moved into the knife-receiving groove 32. The welding jaw 33 cooperates with a second welding jaw 35 in order to provide the continuous tubular film 26 at its leading end with a bottom seam. The knife 34 and the welding jaw 35 are secured to a second link 36, to which a parallel motion is imparted by cranks. The two links 28, 36 are operated by fluid-operable piston-cylinder units.

A further clamping device for clamping the continuous tubular film is provided above the welding jaws 33 and 35 and consists of a turning lever 39, which carries a clamping bar 38 and is movable by a fluid-operable piston-cylinder unit 40. An arm which carries the roller 421 is secured to the turning lever 39. When the turning lever 39 is in clamping position the roller 41 is spaced from a camming member 43. The camming member 43 is connected to a lever 44, which is held against a stop 46 by a spring 45. The pivot of the lever lies on the axis of the pinch roller 47. The lever 44 has a depending extension, which constitutes an abutment 48 for cooperation with the clamping bar 38. For unclamping the sack workpiece after a bottom seam has been formed and a severing cut has been performed, the fluid-operable piston cylinder units 37 and 40 are operated to swing off the links 28, 36 and 39. During that movement the roller 41 engages the cam surface of the camming member 43 so that the backing member 48 is pivotally moved in the direction indicated by the arrow C. As a result, the freely depending end portion of the continuous tubular film 26 is disengaged from the welding jaw 33 and is deflected. That deflection ensures that the continuous tubular film will not collide with the carrier when said continuous tubular film is advanced to the extent of one sack length by the pinch rollers 47 and 51 in the next step.

In order to prevent also a wrapping of the continuous tubular film 26 around the pinch rollers 47 and 51, said pinch rollers are provided with annular grooves 49, 50 for receiving stripping fingers 52 and 53. The fingers 52 are fixed to the frame. The fingers 53 are secured to the backing member 48 and constitute a stripping rake.

When a sack has been gripped by the grippers in the receiving station (the right hand side of FIGS. 1 and 2), and has been severed from the film, the spider 9 is advanced by one 90° step, clockwise in FIG. 2, so that the next pair of grippers at the right hand side can receive the succeeding sack which is advanced by the feed rollers then welded and severed from the film as described. The procedure is repeated with successive sacks which are released at the transfer station (the uppermost pair of grippers in FIG. 2) for delivering by other means to a filling device. It is evident that in proceeding intermittently from the receiving station to the transfer station, each sack passes through two cooling stations namely the positions of the spider at the bottom and left hand side of FIG. 2.

What is claimed is:

1. Apparatus for making bags from a continuous tubular plastic film comprising conveying means for feeding the film intermittently in steps corresponding in length to a required bag length and in a downward direction, a gripping conveyor for receiving successive bag lengths from the conveying means at a receiving station, and delivering bags to a transfer station, a welding means above the gripping conveyor for forming transverse sealing webs at the bottom of each succeeding bag length, and a transverse cutter positioned between the welding means and the gripping conveyor for separating successive bag lengths from the tubular film when the respective bag lengths have been received in the gripping conveyor, wherein the gripping conveyor comprises a hub-like carrier mounted for rotational movement about a vertical axis, the carrier having radially extending arms with outer ends and grippers for the bag lengths on said outer ends for receiving the bag lengths in positions substantially tangentially disposed with respect to the carrier, drive means for rotatably moving the carrier in increments about said axis for moving the bag lengths in sequence from the receiving station through at least one cooling station to the transfer station, the apparatus further including gripper operating means for opening and closing the grippers at the receiving and transfer stations, wherein each of said arms is provided with two grippers and the bag lengths are adapted to be received between a pair of grippers which are on adjacent arms respectively.

2. Apparatus as claimed in claim 1, wherein each arm is provided at its outer end with a bracket defining fixed jaws for respective grippers and each arm further includes a pair of movable jaws which cooperate with the fixed jaws to define the respective grippers.

3. Apparatus as claimed in claim 2, including link means connected between the respective movable jaws on adjacent arms for operation of the jaws in unison.

4. Apparatus as claimed in claim 3, wherein the link means and gripper operating means are operatively associated in the manner for opening and closing in unison those grippers which are located in the receiving station and the transfer station., 5. Apparatus as claimed in claim 3, wherein the movable jaws comprise sprung levers urged into engagement with the respective fixed jaws and wherein the gripper operating means includes a spreader mechanism for engagement between a pair of the levers located on one of the arms thereby opening the respective jaws and, through the link means, opening adjacent jaws on the adjacent arms in unison.

6. Apparatus as claimed in claim 5, wherein the spreader mechanism comprises a pivotal lever having one end formed as a cam for insertion between the sprung levers on the respective arms, the gripper operating means further including a pressure cylinder for moving the pivotal lever between cam-insertion and cam-retraction positions.

7. Apparatus as claimed in claim 6, including safety means for preventing the carrier from rotating when the grippers are opened, the safety means including a plate on the carrier with radial slots extending from a central opening, and a follower on the pivotal lever, the plate being configured for receipt of the follower in a plate slot when the cam is inserted between a pair of the sprung levers thereby preventing rotation of the carrier, and withdrawal of the follower from the slot into the central opening when the cam is retracted from between the sprung levers to permit rotation of the carrier.

8. Apparatus for making bags from a continuous tubular plastic film comprising conveying means for feeding the film intermittently in steps corresponding in length to a required bag length and in a downward direction, a gripping conveyor for receiving successive bag lengths from the conveying means at a receiving station, and delivering bags to a transfer station, a welding means above the gripping conveyor for forming transverse sealing webs at the bottom of each succeeding bag length, and a transverse cutter positioned between the welding means and the gripping conveyor for separating successive bag lengths from the tubular film when the respective bag lengths have been received in the gripping conveyor, wherein the gripping conveyor comprises a hub-like carrier mounted for rotational movement about a vertical axis, the carrier having radially extending arms with outer ends and grippers for the bag lengths on said outer ends for receiving the bag lengths in positions substantially tangentially disposed with respect to the carrier, drive means for rotatably moving the carrier in increments about said axis for moving the bag lengths in sequence from the receiving station through at least one cooling station to the transfer station, the apparatus further including gripper operating means for opening and closing the grippers at the receiving and transfer stations, wherein the welding means includes a fixed welding jaw and a movable welding jaw and wherein the apparatus further includes pivotal abutment means for engaging the film and moving same away from the fixed welding jaw during feeding steps of the film.

9. Apparatus as claimed in claim 8, wherein the abutment means defines a first clamping jaw for the film which is located above the welding jaws, and the apparatus includes a pivoted clamping jaw for engaging the first clamping jaw and retaining the film therebetween during film welding and cutting operations.

10. Apparatus as claimed in claim 9, wherein the abutment means is formed on a pivot member and the apparatus includes mutual engagement means on the pivoted clamping jaw and the pivot member respectively for moving the pivot member responsive to opening movement of the pivoted clamping jaw.

11. Apparatus as claimed in claim 9, wherein the pivot member carries a first film pinch roller and the apparatus includes a second film pinch roller adapted to cooperate with the first pinch roller to grip the film therebetween when the mutual engagement means are out of mutual engagement.

12. Apparatus as claimed in claim 11, wherein the pinch rollers have circumferential grooves and the apparatus includes fixed rakes with fingers located in said grooves for stripping the film from the pinch rollers.

* * * * *